US005398421A

United States Patent [19]

Nicolle et al.

[11] Patent Number: 5,398,421

[45] Date of Patent: Mar. 21, 1995

[54] METHOD FOR CONNECTING MAGNETIC MEASUREMENTS PERFORMED IN A WELL THROUGH A MEASURING DEVICE IN ORDER TO DETERMINE THE AZIMUTH THEREOF

[75] Inventors: Gilles Nicolle; Michel Hourcard, both of Paris; Didier Gazaniol, These; Claude Mabile, Clamart, all of France

[73] Assignee: Institut Francais du Petrole et Societe, Clamart, France

[21] Appl. No.: 246,367

[22] PCT Filed: Dec. 11, 1991

[86] PCT No.: PCT/FR91/01000

§ 371 Date: Aug. 4, 1992

§ 102(e) Date: Aug. 4, 1992

Related U.S. Application Data

[63] Continuation of Ser. No. 917,084, Aug. 4, 1992, abandoned.

[30] Foreign Application Priority Data

Dec. 12, 1990 [FR] France ..... 90 15656

[51] Int. Cl.[6] ..... E21B 47/022

[52] U.S. Cl. ..... 33/302; 33/304; 33/313

[58] Field of Search ..... 33/302, 303, 304, 313, 33/301; 324/221; 364/422

[56] References Cited

U.S. PATENT DOCUMENTS

| | | | |
|---|---|---|---|
| 4,357,660 | 11/1982 | Hepp | 33/302 |
| 4,682,421 | 7/1987 | van Dongen et al. . | |
| 4,956,921 | 9/1990 | Coles | 33/302 |

FOREIGN PATENT DOCUMENTS

| | | | |
|---|---|---|---|
| 0193230 | 9/1986 | European Pat. Off. | 33/302 |
| 2138141 | 4/1983 | United Kingdom . | |
| 2225118 | 11/1988 | United Kingdom . | |
| 2220072 | 12/1989 | United Kingdom | 33/304 |
| 2229273 | 9/1990 | United Kingdom | 33/304 |

*Primary Examiner*—Alvin Wirthlin

*Attorney, Agent, or Firm*—Antonelli, Terry, Stout & Kraus

[57] ABSTRACT

A measuring tool including a device (4) for measuring the terrestrial magnetic field is inserted in a drill string (2) linking a drilling tool (3) to a surface installation. The method allows to be free from the disturbance affecting the measured terrestrial magnetic field and which is due for example to the drill string. It comprises stopping the tool during the progression thereof in the well in successive stop positions longitudinally spaced out in relation to one another, the angular position of measuring device (4) in these positions being random, and using a statistic calculation method for combining the different measurements and determining the disturbing field.

4 Claims, 3 Drawing Sheets

METHOD FOR CONNECTING MAGNETIC MEASUREMENTS PERFORMED IN A WELL THROUGH A MEASURING DEVICE IN ORDER TO DETERMINE THE AZIMUTH THEREOF

This application is a Continuation of application Ser. No. 07/917,084, filed Aug. 4, 1992, now abandoned.

FIELD OF THE INVENTION

The object present invention relates to a method for correcting magnetic measurements performed in order to determine an inclination and an azimuth of a well crossing a subsurface formation, by means of a tool displaced therein, with the method being particularly suitable for correcting measurements achieved by a sonde inserted between a drilling tool and the string linking it to a surface installation so as to enable, for example, to take into account the parasitical magnetic field generated by the drill string, which is superposed on the terrestrial magnetic field.

BACKGROUND OF THE INVENTION

Examples from prior art in the field of well orientation measurement are described in U.S. Pat. Nos. 4,435,454; 4,472,884; 4,559,713; 4,819,336.

While drilling wells and notably more or less deviated deep wells, the angle of inclination of the well and the azimuth thereof are generally to be determined with precision. To that effect, a measuring device included in a drill string inserted above the drilling tool is used.

This device generally comprises three magnetometers for measuring the components of the local magnetic field vector in three orthogonal directions Ox, Oy, Oz. One of the axes Oz is parallel to the axis of the tool and of the drill string. The other two, Ox, Oy are in a plane orthogonal to the axis of the drill string and the orientation thereof with respect to the vertical can be any orientation. Three accelerometers for determining the components Gx, Gy, Gz of the local gravitation vector are also arranged along these three axes. The measurements of the accelerometers enable a calculation of the inclination I of the tool and the orientation thereof, often referred to as TF (for Tool Face), which is the angle between axis Ox and the vertical plane. By combining the measurements Bx, By, Bz of the three magnetometers with the values I and TF obtained, the azimuth of the tool and therefore of the well, which is the angle between the projections in the horizontal plane of the axis of the tool and of the magnetic field, can be calculated.

The drill string, which is made of metal, magnetizes under the influence of the terrestrial magnetic field. Thus, the drill string generates a parasitical magnetic field which is superposed on the terrestrial field and alters the measurements. In order to minimize the parasitical influence, the measuring tool is interposed in a certain length of drill collar made of a nonmagnetic material. The residual disturbance $\vec{P}$ due to the more distant magnetic parts of the drill string is then assumed to be parallel to the axis of the drill string (FIG. 5).

In fact, the existence of a local magnetization ("hot spots") of pipes reputed to be nonmagnetic is often observed. The field generated by these anomalies is generally not parallel to the axis of the drill string. The case of a magnetic disturbance $\vec{P}$ (FIG. 6) of any direction provided with an axial component (axial disturbance) along Oz but also a radial component (radial disturbance) orthogonal to the previous one is thus to be considered.

U.S. Pat. No. 4,163,324 describes a method for eliminating errors due to a magnetic disturbance in the case where the latter may be assumed to be purely axial.

In the case, justified in practice, where no hypothesis can be made on the direction of the disturbance field, a method described in U.S. Pat. No. 4,682,421 may be used, which mainly consists in eliminating the influence thereof by rotating the measuring device about the axis thereof which is substantially parallel to the local direction of extension of the well and, for different angular positions distributed over 360°, in measuring the components of the magnetic field vector. The transverse component of the magnetic disturbance can be eliminated after comparing the measurements performed in several different orientations.

When the drilling tool is connected to a surface maneuvering installation by a rigid drill string which is progressively extended by fixing pipe sections, the measuring method mentioned above may be implemented, for example when the string is being extended. Progression of the tool is stopped. The string is turned around on itself and the measuring devices are rotated thereby. The successive positions thereof are distributed in a circle in a plane transverse to the direction of extension of the well. Measurements are repeated for different successive angular positions in the same longitudinal place in the well.

Each measuring sequence is relatively long, of the order of ten minutes, for example. The multiplicity of the measurements to be performed in each stop place causes an undoubted slowing down of the drilling rate if each sequence is repeated at regular intervals. Stopping of the tool presents another drawback in the relatively frequent case where turbodrilling is performed. The tool is driven by a bottomhole turbine brought in rotation by a mud flow circulating in the drill string and in the annulus between the string and the well. The rotation of the measuring tool linked to the drilling tool, from one angular position to the next one, requires maintaining a mud flow which tends to enlarge the well and to cause instability zones therein.

SUMMARY OF THE INVENTION

The method according to the invention allows to correct magnetic measurements performed in order to determine the azimuth of a well crossing a subsurface formation, through a tool which is displaced therein and notably through a measuring tool inserted in a rigid drill string connecting a drilling tool to a surface installation, comprising using a measuring assembly including magnetic means for measuring the components (Bx, By, Bz) of the magnetic field prevailing locally in the vicinity of the drilling tool, by taking into account the disturbing magnetic field (P) generated by the presence of the rigid string, and means for measuring the components (Gx, Gy, Gz) of the acceleration of gravity.

In accordance with the method of the present invention, a measuring of the components is achieved by stopping the tool during the progression thereof in the well in a succession of stop positions longitudinally spaced out with respect to one another with the successive angular positions of the measuring assembly in the stop positions being random, and determining the disturbing magnetic field by applying a statistic method for taking into the measurement achieved by the measuring assembly in the random angular position taken by the measuring tool.

According to a first implementing, the method comprises determining the radial correction to be brought, by determining a mean value on a fixed interval of the radial components of the disturbing magnetic field through a correlation between an amount depending on the square of the intensity of the field measured by the measuring assembly, and a series of measurements of the radial components of the disturbed field achieved at the random stop positions of the measuring tool.

The correlation comprises, for example, a regression calculation between, an amount equal to the difference between the square of the intensity of the disturbed field (B) and the square of the intensity (Bo) of the magnetic field prevailing in the well in the absence of a disturbance induced by the rigid string, and the components of the disturbed field.

According to a second implementing, the radial correction to be brought is determined by determining a mean value on a fixed interval of the radial components of the disturbing field, by correlating a deviation between the projections on a horizontal plane of the disturbed field and of the magnetic field in the absence of a disturbance, and the radial components of the acceleration of gravity achieved in the random stop positions of the measuring tool.

The method defined above may also comprise determining the axial correction to be brought, which minimizes the difference between the corrected magnetic field and the undisturbed magnetic field.

The method according to the invention suppresses, for example, when applied to drilling, many of the operating constraints imposed by measurements performed with a tool stopped in a well. Acquisition of various measurements angularly distinct from one another does not require prolonged stops of the drilling tool at the same depth level which, as it is well-known, are likely to destabilize the well. It is sufficient to temporarily stop the rotation of the drilling tool in a random angular position during the progression thereof in order to carry out measurements and to repeat the same operation at several successive depths. Constraints are further reduced by taking advantage of stops imposed during drilling operations, such as, for example, the connection of additional sections to the drill string, to make the drilling tool progress deeper.

BRIEF DESCRIPTION OF THE DRAWINGS

Other features and advantages of the method and of the device according to the invention will be clear from reading the description hereafter of an embodiment given by way of non limitative example, with reference to the accompanying drawings wherein.

DESCRIPTION OF THE PREFERRED EMBODIMENTS

Figure 1:
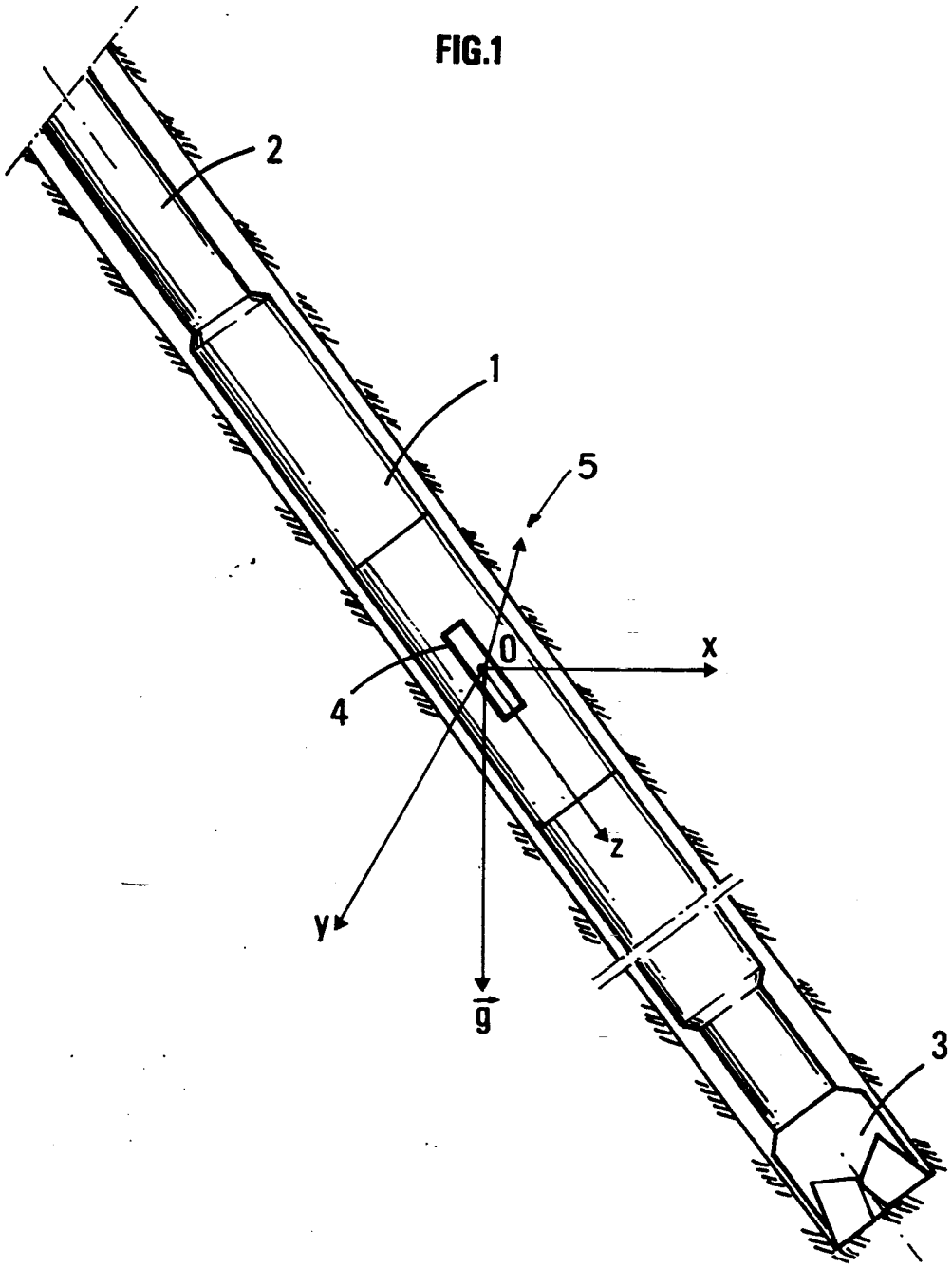
FIG. 1 diagrammatically shows a drilling tool in a well, topped by a measuring device.

A measuring tool 1 is inserted in a rigid drill string 2 connecting a drilling tool 3 to a drill rig (not shown). An assembly 4 for measuring the acceleration of gravity and the magnetic field is placed in measuring tool 1. This assembly 4 comprises, for example, three accelerometers for measuring the components Gx, Gy, Gz of the acceleration of gravity G along three orthogonal axes OX, OY, OZ. Axis OZ is parallel to the axis of the drill string 2, and axes OX and OY are fixed with respect to the measuring tool 1 and the drill string 2. Measuring assembly 4 also comprises three magnetometers for measuring, along the same axes, the components of the terrestrial magnetic field Bo. In the absence of a disturbing field, it is known to obtain the azimuth of well 5 through a combination of the components of acceleration G and of vector Bo. The inclination angle I of the tool and the orientation thereof, often referred to as TF (for Tool Face Angle) are first calculated with the following two relationships:

$$\tan I = \sqrt{(Gx^2 + Gy^2)}\ /Gz \text{ and}$$

$$\tan TF = -\ Gy/Gx$$

The azimuth A of the well is the angle between the projections in the horizontal plane of the undisturbed terrestrial magnetic field BO and the axis of the drill string OZ. It is calculated from the raw measurements Box, Boy, Boz, performed respectively by the three magnetometers, of inclination angle I and of angle TF with the following relationship:

$$\tan A = -B'y/(Boz \sin I + B'x \cos I) \quad (1)$$

knowing that the values of B'x and B'y are obtained with the relations:

$$B'x = Box \cos TF - Boy \sin TF \quad (2) \text{ and}$$

$$B'y = Box \sin TF + Boy \cos TF \quad (3)$$

In the application described, one has to take into account the magnetic disturbance caused by a possible local defect of one of the drill collars close to the measuring tool, which distorts the previous calculations. Bo and B will hereafter respectively refer to the intensity of the terrestrial magnetic field whose components along the three axes are Box, Boy and Boz, and the disturbed magnetic field Do and B will respectively refer to the angle of dip of the magnetic fields Bo and B and P to the magnetic disturbance of co-ordinates Px, Py, Pz.

The azimuth correction method according to the invention first comprises determining the radial correction to be brought. While taking into account the disturbance, the components Bx, By, Bz of the magnetic field measured by the three magnetometers are respectively:

$$Bx = Box + Px$$

$$By = Boy + Py$$

$Bz = Boz + Pz.$

According to a first variant of the method according to the invention, the radial correction is determined by seeking a mean value on a fixed interval of the components Px, Py of the disturbance and of the components Bx, By of the disturbed field, through a correlation between the square of the intensity of the measured field and a series of measurements of components Bx, By obtained randomly.

This series is obtained in the present method by stopping the tool in random angular positions. Stopping the tool can be done at any time during the progression of the tool. In case of rotary type drilling, advantage can be taken of stops imposed during drilling operations for adding new pipes to the string, knowing that the angular position of the tool at the time of these stops is totally random. The following relationship:

$$B^2 = (Box + Px)^2 + (Boy + Py)^2 + (Boz + Pz)^2$$

between the field Bo, the disturbed field B and disturbance P can also be written as follows:

$$B^2 = Bo^2 + 2(Px \cdot Box + Py \cdot Boy + Pz \cdot Boz) + P^2.$$

Disturbance P being generally less than the terrestrial field Bo, the second order terms can be disregarded and the previous relationship can be written as follows:

$$B^2 - Bo^2 = 2(Px \cdot Bx + Py \cdot By + Pz \cdot Bz).$$

The orientation angle TF varies rapidly from one measurement to the next because of the rotation of the drill string. Axes Ox, Oy rotating with the string, the projections Bx, By of the magnetic field on these axes change fast and randomly on a set of measurements. On the other hand, as axis Oz remains parallel to the direction of the well, the variation of component Bz is much slower and regular. Besides, the magnetic disturbance being generated by the drill string, the components Px, Py, Pz thereof, in a reference related thereto, are constant.

It is therefore justified to consider that, for all the measurements performed:

Bx and By are independent random variables, $B^2$ is a random variable depending on Bx and By, Px and Py are the corresponding regression coefficients, and $Bo^2$ and Pz·Bz are constant terms.

A good approximation to Px and Py is thus obtained by calculating the value of $B^2$, for each one of the measurements of the series of measurements performed during the random stops of the tool, and by performing a multiple regression calculation on the values of $B^2$ with respect to Bx and By so as to determine Px and Py which are the regression coefficients sought.

According to one variant, the radial correction to be brought is calculated by using the value of the dip D of the disturbed field which is measured during the same series of random stops as previously. D being the dip of field B, the projection B·cos D thereof in a horizontal plane is obtained with the relation:

$$B \cdot \cos D = Gx \cdot Bx + Gy \cdot By + Gz \cdot Bz$$

$$= Gx \cdot (Box + Px) + Gy \cdot (Boy + Py) + Gz \cdot (Boz + Pz)$$

Since Bo·cos Do equals Gx·Box+Gy·Boy+Gz·Boz, it follows therefrom that the deviation E=B·cos D and Bo·cos Do between the projections is expressed by:

$$E = Px \cdot Gx + Py \cdot Gy + Pz \cdot Gz$$

Correlation coefficients which can be related to components Px and Py are obtained through an analogous regression calculation between E on the one hand and Gx and Gy on the other hand.

The radial correction being calculated, a value of the axial disturbance Pz can then be calculated so as to minimize the difference between the corrected magnetic field vector B-Pz and the undisturbed magnetic field B which is known.

Figure 2:
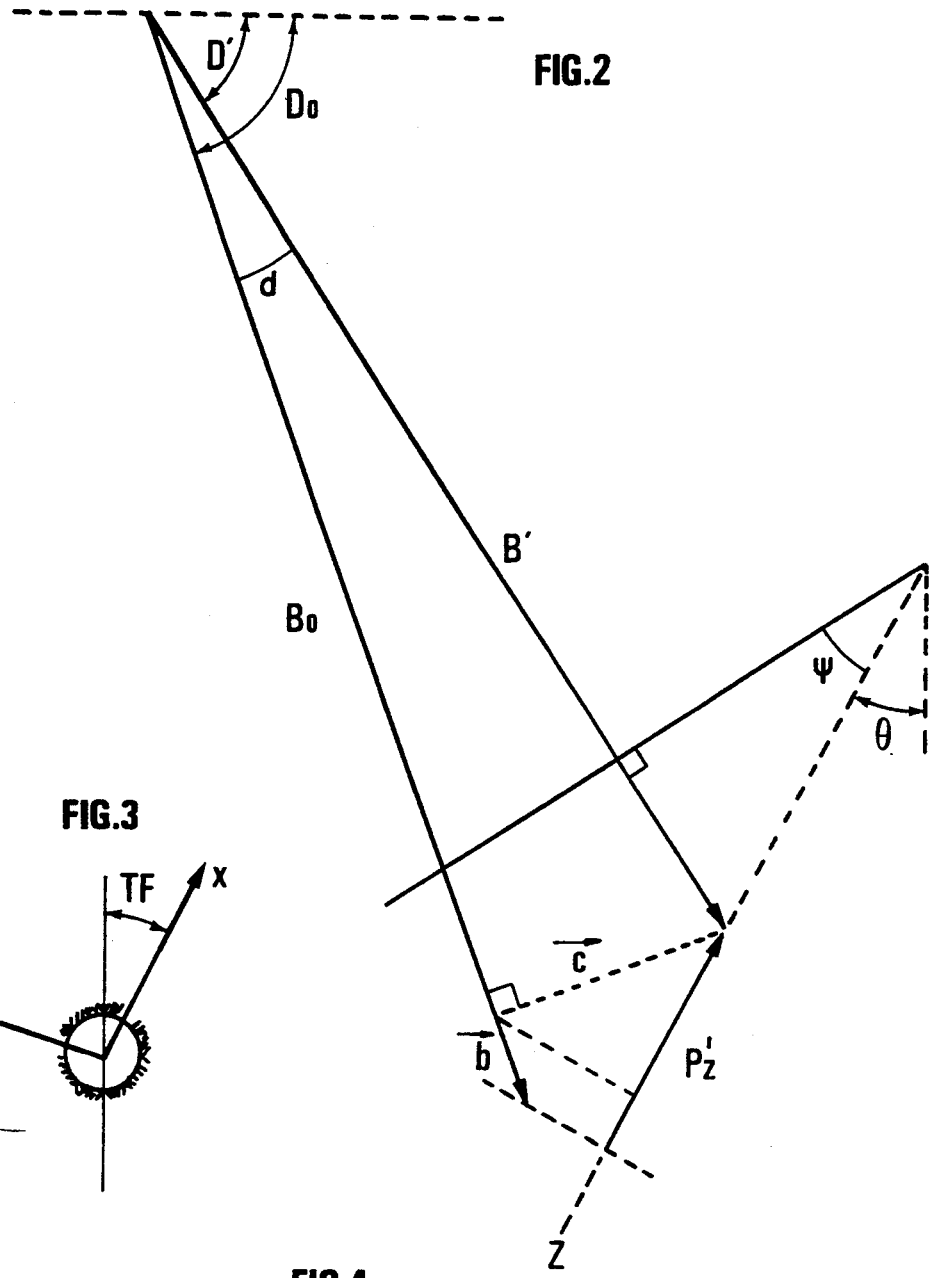
FIG. 2 shows a representation of magnetic vectors in the vertical plane of the magnetic field.
Figure 3:
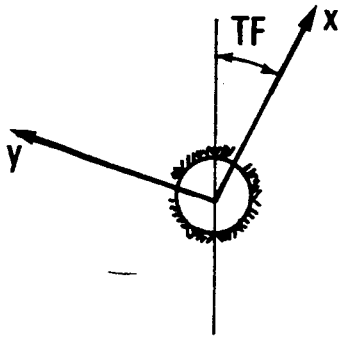
FIG. 3 is a vectorial diagram showing the trace of the vertical plane containing the tool and the angle TF defining the orientation thereof.
Figure 4:
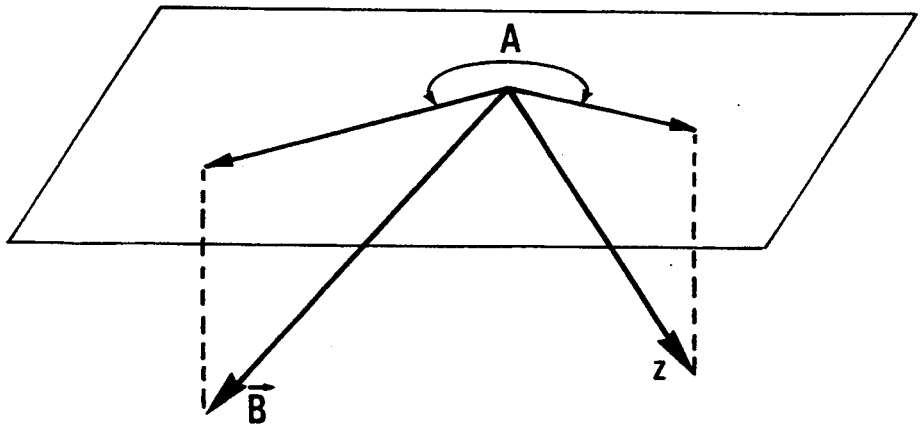
FIG. 4 is a vectorial diagram showing the wanted azimuth angle A.
Figure 5:
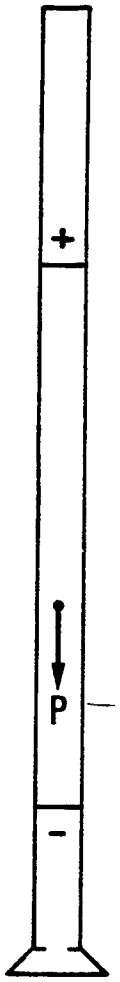
FIG. 5 diagrammatically shows a measuring tool inserted between nonmagnetic drill collars.
Figure 6:
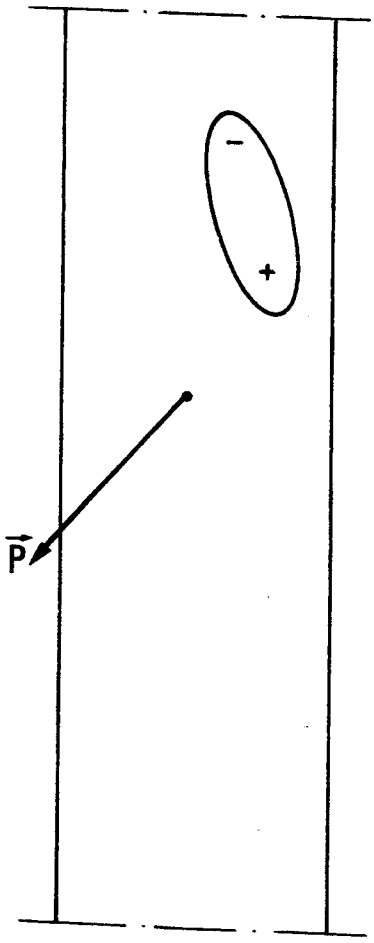
FIG. 6 shows the magnetic disturbance generated by the local existence of a defect in a nonmagnetic drill collar.

In FIG. 2, which shows vectors projected in a vertical plane:

B' and D' are respectively the intensity and the dip of the projection in this plane of the magnetic field after incorporation of the previous corrections Px and Py;

$\theta$ is the angle between the projection in the same plane of the string axis, and the vertical, Z refers to the projection in the same plane of the string axis, $\psi$ is the difference $(D' - \theta)$, and P'z represents the projection of Pz in the same plane.

The component P'z such that vector $Bo - (B' - P'z)$ is orthogonal to P'z is sought. The angle $\theta$ is related to the inclination I and the measured azimuth A through the relationship:

$$\tan\theta = \tan I \cdot \cos A.$$

The differences $b = (Bo - B')$ and $d = (Do - D')$ being small, segment c (FIG. 2) can be calculated with the $|\vec{c}| = Bo \cdot d$.

The projection P'z is calculated by projecting the segments b and c upon the direction Oz, which leads to the relationship:

$$P'z = b \cdot \sin\psi + c \cdot \cos\psi$$

P'z being the projection of Pz upon the vertical plane of the magnetic field, Pz is finally obtained through the relationship:

$$Pz = P'z / \sqrt{(\sin^2 I \cos^2 A + \cos^2 I)}$$

After calculating successively the disturbance components Px and Py, then Pz, the components Bx, By and Bz of vector B are determined and, by applying the previous relationships 1 to 3 applied to vector B, the exact azimuth A which is sought can be determined.

We claim:

1. A method for correcting magnetic measurements performed in order to determine an azimuth of a well crossing a subsurface formation, through a measuring assembly interposed on a rigid drill string connecting a drilling tool to a surface installation, said measuring assembly including only one set of magnetic measuring means fixed at a location on the rigid drill string for measuring three components of a magnetic field prevailing locally in a vicinity of the drilling tool along a longitudinal direction and transverse orthogonal directions taking into account any disturbing magnetic field generated by the presence of the rigid drill string, and a set of accelerometers fixed on the rigid drill string at the location for measuring three components of the acceleration of gravity prevailing at the location comprising:

stopping the drilling tool during a progression thereof in the well in a succession of stop positions longitudinally spaced from each other such that successive angular positions of the measuring assembly at the stop positions are random;

measuring the three components of the magnetic field and the three components of acceleration of gravity at each respective random stop position with the one set of magnetic measuring means and the set of accelerometers;

determining the disturbing magnetic field by applying a regression calculation accounting for the measurements performed. by the measuring assembly at the random angular positions of the stop positions; and radially correcting the magnetic measurements by determining a mean value on a fixed interval of radial components of the disturbing magnetic field by a correlation between an amount depending upon a square of an intensity of a field measured by the measuring assembly and a series of measurements of the radial components of the disturbed magnetic field performed at the random angular positions of the stop positions of the measuring assembly.

2. A method as claimed in claim 1 wherein the correlation comprises:

a regression calculation between an amount equal to a difference between a square of an intensity of the disturbed magnetic field and a square of the intensity of the magnetic field prevailing in the well in an absence of a disturbance induced by the string and components of the disturbed magnetic field.

3. A method for correcting magnetic measurements performed in order to determine an azimuth of a well crossing a subsurface formation, through a measuring assembly interposed on a rigid drill string connecting a drilling tool to a surface installation, said measuring assembly including only one set of magnetic measuring means fixed at a location on the rigid drill string for measuring three components of a magnetic field prevailing locally in a vicinity of the drilling tool along a longitudinal direction and transverse orthogonal directions taking into account any disturbing magnetic field generated by the presence of the rigid drill string, and a set of accelerometers fixed on the rigid drill string at the location for measuring three components of the acceleration of gravity prevailing at the location comprising:

stopping the drilling tool during a progression thereof in the well in a succession of stop positions longitudinally spaced from each other such that successive angular positions of the measuring assembly at the stop positions are random;

measuring the three components of the magnetic field and the three components of acceleration of gravity at each respective random stop position with the one set of magnetic measuring means and the set of accelerometers;

determining the disturbing magnetic field by applying a regression calculation accounting for the measurements performed by the measuring assembly at the random angular positions of the stop positions; and radially correcting the magnetic measurements by determining a mean value on a fixed interval of radial components of the disturbing magnetic field by a correlation between a deviation between projections on a horizontal plane of the disturbed magnetic field and the magnetic field in an absence of a disturbance and radial components of an acceleration of gravity performed at the random angular position of the stop positions of the measuring assembly.

4. A method as claimed in one of claims 1, 2 or 3 further comprising:

axially correcting the magnetic measurements which minimizes a disturbance between a corrected magnetic field and an undisturbed magnetic field.

* * * * *